United States Patent [19]

Lanti-Montefeltro Della Rovere

[11] 4,352,496

[45] Oct. 5, 1982

[54] PLASTIC AND METAL TARGET PIGEON

[76] Inventor: Ludovico Lante-Montefeltro Della Rovere, 171 Spring Hill Rd., Trumbull, Conn. 06611

[21] Appl. No.: 197,126

[22] Filed: Oct. 15, 1980

Related U.S. Application Data

[63] Continuation-in-part of Ser. No. 65,467, Aug. 10, 1979, Pat. No. 4,335,882, which is a continuation-in-part of Ser. No. 921,006, Jun. 30, 1979, Pat. No. 4,206,919, which is a continuation-in-part of Ser. No. 762,019, Jan. 24, 1977, Pat. No. 4,133,532, and a continuation-in-part of Ser. No. 882,907, Mar. 1, 1978, Pat. No. 4,274,636, and a continuation-in-part of Ser. No. 892,921, Mar. 3, 1978, Pat. No. 4,218,061.

[51] Int. Cl.[3] ..... F41J 9/16

[52] U.S. Cl. ..... 273/363; 273/365

[58] Field of Search ..... 273/362–365

[56] References Cited

U.S. PATENT DOCUMENTS

| | | | |
|---|---|---|---|
| 152,101 | 6/1874 | Glahn | 273/365 |
| 326,664 | 9/1885 | Macomber | 273/365 |
| 957,742 | 5/1910 | Chiantore | 273/365 |
| 1,368,176 | 9/1921 | McMillan | 273/365 |
| 1,369,830 | 3/1921 | Mitchell | 273/363 |
| 4,206,919 | 6/1980 | Della Rovere | 273/364 |
| 4,218,061 | 8/1980 | Della Rovere | 273/364 |

FOREIGN PATENT DOCUMENTS

| | | | |
|---|---|---|---|
| 687941 | 6/1964 | Canada | 273/363 |
| 2100107 | 7/1972 | Fed. Rep. of Germany | 273/365 |

*Primary Examiner*—Paul E. Shapiro
*Attorney, Agent, or Firm*—Karl F. Ross

[57] ABSTRACT

A target pigeon has a base part comprising a generally flat web formed at a web axis with a central throughgoing hole and having a pair of diametrically opposite ends on which are mounted diametrically opposite vanes that are tipped propeller-fashion to each other. A pair of diametrically opposite holding tabs are provided on the ends of the webs and directed generally axially and tipped inwardly toward each other. The entire web has a relatively great mass, normally in excess of 40 g. A cup-shaped witness cap having a relatively small mass in the neighborhood of approximately 4 g. has an axially directed and substantially circular annular rim that is centered on the cap axis and is formed with a pair of diametrically opposite lips in turn each formed with an outwardly open notch. This rim is engageable with the ends of the web inwardly of the tabs with the tabs fitting in the notches. Arcuate sections of the cap are exposed to either sides of the relatively narrow ringless web.

10 Claims, 7 Drawing Figures

PLASTIC AND METAL TARGET PIGEON

CROSS-REFERENCE TO RELATED APPLICATIONS

This application is a continuation-in-part of my copending application Ser. No. 065,467 filed Aug. 10, 1979, now U.S. Pat. No. 4,335,882 as a continuation-in-part of application Ser. No. 921,006 filed June 30, 1979 which issued as U.S. Pat. No. 4,206,919 and which itself was a continuation-in-part of my earlier applications Ser. Nos. 762,019 filed Jan. 24, 1977 (now U.S. Pat. No. 4,133,532), 882,907 of Mar. 1, 1978 now U.S. Pat. No. 4,274,636, and 892,921 filed Mar. 3, 1978 (now U.S. Pat. No. 4,218,061).

FIELD OF THE INVENTION

The present invention relates to a target pigeon. More particularly this invention concerns such a target pigeon useful with a launching apparatus such as described in my U.S. Pat. No. 4,077,384.

BACKGROUND OF THE INVENTION

My above-cited copending application Ser. No. 065,467 describes a sheet-metal target pigeon whose body part has a generally flat web formed with a central throughgoing hole and having a pair of diametrically opposite ends from each of which extends a respective vane, these vanes being tipped propeller-fashion to each other. The target pigeon also has a cup-shaped witness cap having a substantially circular rim centered on a cap axis and having an axially directed end engageable with the web at the ends thereof and fully exposed at arcuate sides or sections diametrically flanking the web. An end plate extends across and closes this rim at the opposite axial end thereof. Means is provided including interengaging formations on the ends of the web and on the rim for releasably securing the body part and witness cap together with the web and cap axes aligned and the one end of the rim bearing on the web ends thereof. This means frees the cap from the rim when the cap is impacted.

These interengaging formations comprise substantially straight and generally axially projecting sheet-metal tabs that are outwardly tipped and diametrically opposite each other. Their axial heights above the web are (substantially) greater than the thickness of the sheet metal forming the web. In turn the cap is formed at the end of its rim opposite the closing end plate with a pair of outwardly directed diametrically opposite lips each formed with a throughgoing aperture. The sheet-metal tabs of the web engage through these apertures and in fact constitute the sole holding and centering means for the cap on the web.

This sheet-metal target pigeon can be produced at much lower cost than the hitherto target pigeons made entirely of plastic. It has surprisingly been shown to be re-usable for several times, something hitherto impossible with a target pigeon.

The sole difficulty with this sheet-metal target pigeon is that it must be made to extremely close tolerances. The interengaging formations that secure the cap to the web must be prefectly positioned so that the cap is perfectly centered on the rotation axis of the target pigeon. Any eccentric mounting will cause the two parts to separate prematurely, ruining the shot.

OBJECTS OF THE INVENTION

It is an object of the present invention to advance the principles of my above-cited applications and patents.

Another object is to provide an improved target pigeon which can be produced at yet lower cost than the above-described sheet-metal target pigeon, yet which will otherwise exhibit all of its advantages.

SUMMARY OF THE INVENTION

These objects are attained according to the instant invention by forming the cap part of a material such that it has a mass which is equal to only a small fraction, at most one-eighth and preferably at most one-tenth, of the mass of the base part. Making the cap so very light allows relatively uncomplicated holding formations to be used. According to this invention the cap is made of part-spherical shape with a circular annular rim formed with a pair of diametrically opposite and outwardly extending lips each having a respective outwardly open notch. The web is formed at each end with a pair of axially and inwardly tipped tabs that engage in these notches and secure the cap to the base part.

Due to the extemely low mass of the cap part its exact centering on the base part is not extremely critical, so that even if turned at a standard launch speed of upwards of 6000 rpm, the parts will not separate. On the other hand, however, any impact suffered by the cap will immediately and instantaneously separate it from the base part.

According to further features of this invention the base part is of the ringless type, as covered by my U.S. Pat. No. 4,206,919, and as contrasted to the older style of U.S. Pat. No. 3,176,988 that has a centering ring for securing the witness disk on the base part. This leaves arcuate sections of the witness cap exposed to either side of the web, ensuring that a maximum amount of area of the cap will be exposed to the shooter. Thus the possibility of a pellet striking the web and not separating the two parts of the target pigeon is greatly reduced. Furthermore the low mass of the cap makes centering it on the base part less important as described above, so that the provision of this ring which not only shields the cap, but which also adds considerably to the cost of manufacturing the base, is eliminated.

It is possible with the system of the instant invention to also incorporate a vessel containing light material such as feathers or foam-plastic pellets in the target pigeon. To this end the vessel is removably mounted on the web and is open toward the cap. The cap will close the vessel when secured by the tabs to the web so as to hold the mass of the relatively light material in the vessel. When separated, however, the light material will spread out and give a very clear visual indication of a successful shot. The extremely light witness disk according to the instant invention will itself provide a relatively good indication, as its ratio of surface area to mass, that is its surface density, is extremely low so that it will fall relatively slowly to the ground.

Thus the use of a disk having extremely low mass offers several new and unobvious advantages. First of all it allows relatively simple holding formations to be employed so that the manufacturing cost of the target pigeon is reduced. In addition the overall cost of the target pigeon can be reduced in general by making this cap of a relatively cheap synthetic resin by extremely common injection-molding techniques. What is more the visual indication offered by a target pigeon thus constituted is substantially better than with any of the prior-art target pigeons.

SPECIFIC DESCRIPTION

Figure 1:
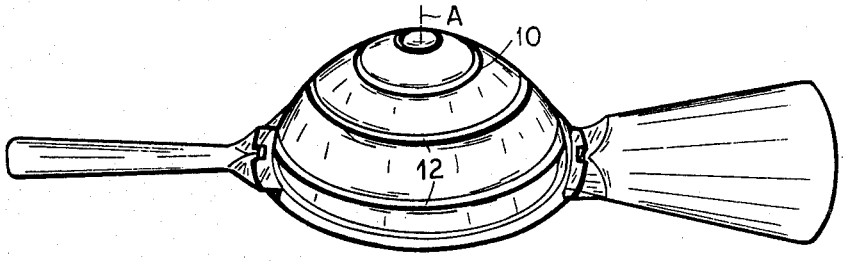
FIG. 1 is a perspective view of the target pigeon according to this invention.
Figure 2:
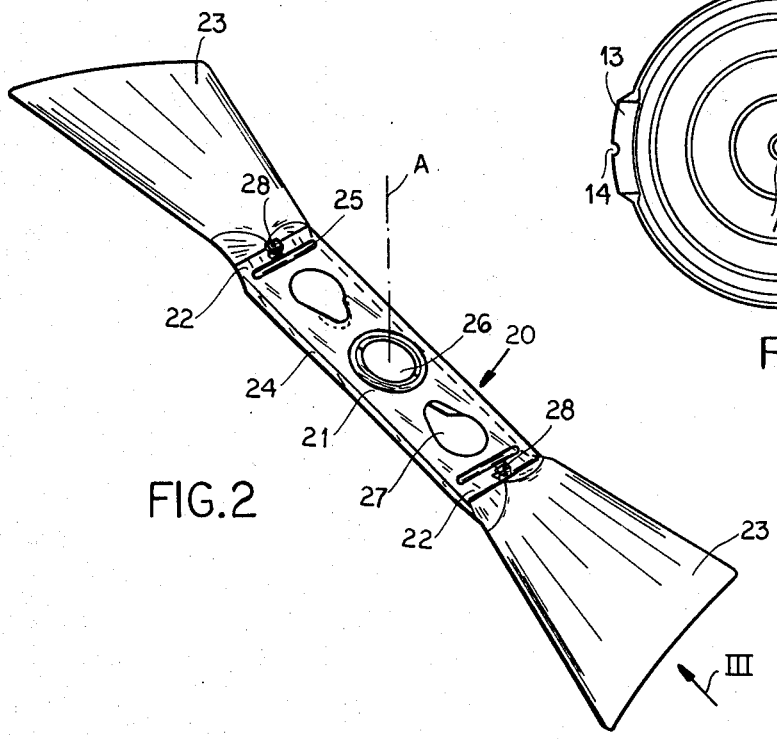
FIG. 2 is a perspective view of the propeller part of the pigeon according to this invention.
Figure 3:
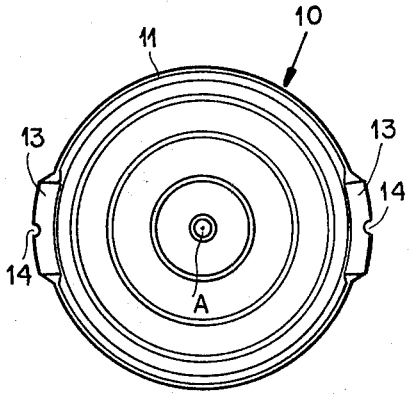
FIG. 3 is a top view of the cap of the target pigeon of this invention.

A target pigeon according to this invention basically comprises as shown in FIGS. 1–4 a witness cap 10 and a base 20. The cap 10 according to this invention has a weight of 4 g and a wall thickness of approximately 12 mil, and is formed by injection molding. The base part 20 is made of sheet steel and has a weight of approximately 42 g, although a heavier model having a weight of approximately 76 g has been tested and found extremely durable. The two parts are normally centered on a common axis A which constitutes both the cap axis and the base axis.

The cap 10 is generally part spherical and has a rim 11 forming a circle centered on the axis A, and is formed with a plurality of circumferential stiffening grooves 12. Extending diametrically oppositely from the rim 11 are a pair of flanges or lips 13 each formed with an outwardly open notch 14. The entire cap 10 is relatively easily deformed.

The propeller or base part 20 has a central web 21 having a pair of ends 22 from each of which extends a vane 23, the vanes 23 being tipped propeller-fashion relative to each other. The web 21 has a pair of side edges extending parallel to each other and formed with respective bent-down stiffening flanges 24. In addition at each of the ends 22 the web 21 is formed with a transverse stiffening rib 25. In addition the web 21 is formed at its center with a throughgoing hole 26 and to each side of this hole 26 with a pair of drive holes 27. In all these respects this part 20 is identical to the element shown at 5 in my above-cited application Ser. No. 065,467.

Figure 5:
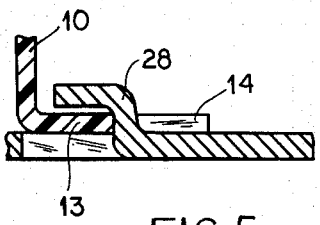
FIG. 5 is a large-scale section through a detail of the target pigeon.
Figure 4:
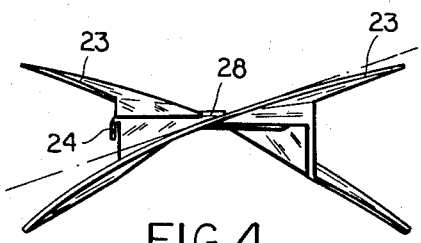
FIG. 4 is an end view taken in the direction of arrow IV of FIG. 2.

Punched out of the ends 22 of the web 21 are tabs 28 which extend axially upwardly and inwardly, as shown also in FIG. 5. These tabs may be L-shaped as shown in FIG. 5 or simply inclined inwardly at an angle of approximately 30°. The distance along the diameter between these two tabs 28 is slightly less than the distance along a diameter between the bases of the two notches 14 so that the cap 10 is slightly compressed along these diameters when it is mounted in place on the propeller part 20 with the notches 14 engaged around the tabs 28.

The upper surface of the web 21 is preferably planar so that the lips 13 fit flatly on this upper surface, the reinforcing ridges 25 forming grooves at this surface, for a relatively stable seating of the cap 10 on the base 20. The hold by means of the tabs 28 in the notches 14 is altogether sufficient to retain the cap 10 on the base 20 even during high speed rotation, up to 8000 rpm, prior to launching of the device.

Figure 6:
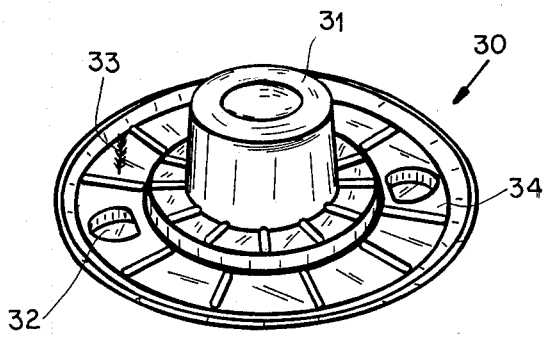
FIG. 6 is a perspective view of an insert usable in the target pigeon of this invention.
Figure 7:
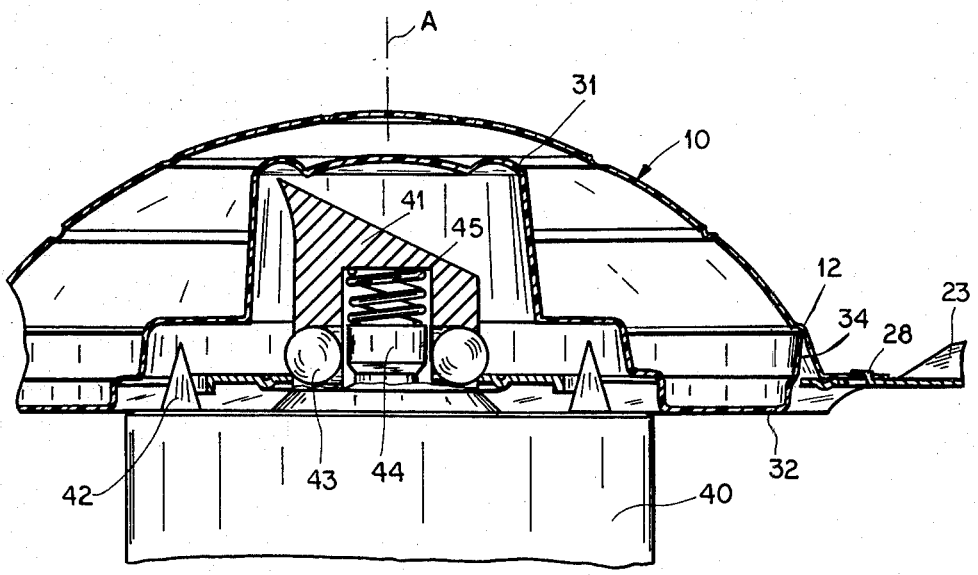
FIG. 7 is a section through the center part of a target pigeon according to this invention mounted on a launch bead.

It is possible to incorporate in this arrangement a vessel 30 of the type shown generally at 36 in FIG. 6 of my above-described patent application Ser. No. 065,467. This vessel 30 has a central boss 31 so that when mounted on a launch head 40 the launch tip 41 of this launch head 40 can pass through the hole 26. In addition the vessel 30 is formed with a pair of downwardly projecting bosses 32 that fit into the outer portions of the teardrop-shaped holes 27 of the web 22, outwardly of the inner portions where conical drive pins 42 of the head 40 engage, so as rotationally to couple the target pigeon with the head 40 for rotation about the axes A. Feathers such as shown at 32 are normally carried in the space formed between the vessel 30 and the cap 10, the vessel 30 to this end having a lip 34 which engages in one of the reinforcing ridges 12 to form a closed feather-containing chamber. When the cap 10 separates from the base part 20 these feathers 33 will be released to provide a very lifelike effect.

The target pigeon is retained on the head 40 by a pair of balls 43 normally urged outwardly by a pin 44 which may be advanced against the force of a spring 45 to release them, in the manner described in U.S. Pat. No. 4,077,384 or U.S. patent application Ser. No. 129,259 filed Mar. 11, 1980.

The target pigeon is normally delivered to the user with the parts 10 and 20 separate, normally nested compactly together. It is an extremely simple matter to snap the cap 10 on a base 20 and press it over a launch tip 41 to secure to a launch head 40. If the vessel 30 with feathers 33 is used the unit can be delivered fully assembled.

The entire target pigeon is rotated about the axes A at high speed, normally between 5500 rpm and 8000 rpm. Normally three such machines rotating target pigeons are provided hidden in an arc approximately 25 m from the shooter's position, the widest machines in the arc forming an angle of approximately 165°. On a signal from the shooter one of the machines, chosen randomly, fires its target pigeon and the shooter has two shots to down it. Any pellet impinging on the cap 10 will surely knock it loose from the base 20, thereby destabilizing the target pigeon so that both parts flutter down to the ground. As substantial arcuate sections of the cap 10 are exposed to either side of the web 21, and further sections of the cap 10 are exposed through the holes 26 and 27, the likelihood of directly impacting this cap 10 is considerable. Even if the base part 20 is impacted, the impact will normally cause it to shift so suddenly in its trajectory that it will shed the cap 10 and similarly destabilize the target pigeon. The provision of feathers such as shown at 33 or small foam-plastic balls in the target pigeon enhances the separation effect, making a hit clearly visible even at a considerable distance. Such an arrangement is preferable for competition shooting where some members of the audience might be relatively far from the shooting stand.

I claim:

1. A target pigeon comprising:

a generally flat web formed at a web axis with a central throughgoing hole and having a pair of diametrically opposite ends;

a pair of vanes on said web extending diametrically oppositely from said ends thereof and tipped propeller-fashion to each other;

a pair of diametrically opposite holding tabs on said ends of said webs directed generally axially and tipped inwardly toward each other, said vanes, web, and tabs being integrally formed and together having a predetermined relatively great mass; and a cup-shaped witness cap having an axially directed and substantially circular annular rim centered on a cap axis and formed with a pair of diametrically opposite outwardly open notches, said rim being axially engageable with said ends of said web inwardly of said tabs with said tabs fitting in said notches, said cap having a predetermined relatively small mass equal to at most one-eighth of said great mass.

2. The target pigeon defined in claim 1 wherein said web is of a predetermined maximum width measured in a plane perpendicular to said web axis, said cap being fully exposed at arcuate sections diametrically flanking said web when engaged with said tabs.

3. The target pigeon defined in claim 2 wherein said web has a substantially planar upper surface engaging said rim of said cap, said tabs standing up from said upper surface.

4. The target pigeon defined in claim 3 wherein said web, vanes, and tabs are integrally made of metal and said cap is made of a synthetic resin.

5. The target pigeon defined in claim 4 wherein said cap has when not engaged with said tabs a predetermined length dimension between the bases of said notches which is longer than the diametrical distance between said tabs, said cap being limited by elastically deformable and compressed diametrically when engaged between said tabs.

6. The target pigeon defined in claim 3 wherein said cap has a pair of diametrically opposite and radially outwardly projecting lips formed with said notches, said cap being substantially rotation symmetrical about said cap axis except for said lips and notches.

7. The target pigeon defined in claim 6 wherein said cap is part spherical except for said lips and notches.

8. The target pigeon defined in claim 7 wherein said cap is formed with a plurality of axially spaced annular rigidifying grooves lying in respective planes perpendicular to said cap axis.

9. The target pigeon defined in claim 3 wherein said web has a pair of generally parallel secantally extending edges each formed with a bend-down stiffening flange, said arcuate sections being defined by said secant edges.

10. The target pigeon defined in claim 1, further comprising:

a vessel removably mounted on said web and open toward said cap, said cap closing said vessel when secured by said tabs to said web; and a mass of relatively light material filling said vessel.

* * * * *